United States Patent [19]

Gorlitsyn et al.

[11] 4,186,588

[45] Feb. 5, 1980

[54] DEVICE FOR FEEDING AUXILIARY TOOLS INTO WORKING ZONE OF PRESS

[76] Inventors: Sergei N. Gorlitsyn, prospekt Ordzhonikidze, 10, kv. 80; Mikhail R. Kavitsky, ulitsa Bakinskikh komissarov, 58, kv. 164; Vladimir I. Koires, ulitsa Bakinskikh komissarov, 58, kv. 83, all of Sverdlovsk, U.S.S.R.; Leonid A. Efimov, deceased, late of Sverdlovsk, U.S.S.R.; by Iraida I. Gebler, administratrix, ulitsa Khmeleva, 18, kv. 77, Sverdlovsk, U.S.S.R.

[21] Appl. No.: 868,919

[22] Filed: Jan. 12, 1978

[51] Int. Cl.[2] ..... B23Q 3/00

[52] U.S. Cl. ..... 72/394; 29/568; 72/398

[58] Field of Search ..... 72/394, 398, 396; 29/568, 34 R, 40, 41, 46

[56] References Cited

U.S. PATENT DOCUMENTS

| | | | |
|---|---|---|---|
| 3,608,188 | 1/1969 | Seidel | 29/568 |
| 3,619,898 | 11/1971 | Perry | 29/568 |
| 3,816,904 | 6/1974 | Herb | 29/568 |

*Primary Examiner*—Francis S. Husar
*Assistant Examiner*—Gene P. Crosby
*Attorney, Agent, or Firm*—Fleit & Jacobson

[57] ABSTRACT

The present invention relates to devices for feeding an auxiliary tool into the working zone of a press and can be used most efficiently in hydraulic free-forging presses. The device comprises a body in the form of a horizontally-movable platform located close to a supporting element and mounting a number of tool rods which are set with a provision for being moved relative to the platform by a discrete feed mechanism and for turning in a vertical plane around the supporting element. This layout of the device broadens considerably the technological capabilities of the press and reduces the manual labor and the time spent for feeding the tool.

5 Claims, 5 Drawing Figures

DEVICE FOR FEEDING AUXILIARY TOOLS INTO WORKING ZONE OF PRESS

The present invention relates to hydraulic presses and more particularly it relates to devices for feeding an auxiliary tool into the working zone of a press.

The present invention will be used most effectively in hydraulic presses for free forging, i.e. in the presses where such auxiliary operations as cutting and piercing call for feeding auxiliary tools, e.g. a hammer cutter, a piercer, etc.

At present the auxiliary tools in free-forging presses are fed by a crane which grips the tool and feeds it into the working zone of the press, in which case the tools are stowed on stands. Such a feed of the working tools calls for the use of physical labour because said tools must be directed into said zone manually. Besides, cranes are scarce in the press-forging shops.

It is possible to dispense partly with manual labour by using some devices for feeding the auxiliary tools which comprise a body installed on a base and carrying a tool rod, said device also comprising a drive for moving the body with the rod to feed the tool into the working zone of the press.

The tool is fed as follows. Before work, the required tool is fastened by hand on the free end of the rod and said rod is moved by the drive horizontally, feeding the tool into the working zone of the press. The foremost position corresponds to the central position of the tool in the press. The working effort is transmitted to the tool from a movable cross-head on its down stroke. On completion of the technological operation the cross-head rises and releases the tool. Then the drive is again turned on to withdraw the rod with the tool to the initial position.

The known device is characterized by a number of disadvantages.

The provision of a single rod enables only one tool to be fed into the working zone of the press which limits the technological capabilities of the device. Besides, such a device is suitable for feeding only small tools and cannot be utilized in powerful presses where auxiliary tools reach considerable weights. In addition, such devices still call for the use of manual labour for replacing and installing the tool in the rod.

An object of the present invention resides in eliminating the aforesaid disadvantages.

An object of the present invention is to provide a device for feeding an auxiliary tool wherein the body and tool rods would be designed so as to widen the technological capabilities of the press.

An important object of the invention lies in providing a device with a similar design of the body and tool rods which would reduce the amount of manual labour and the time spent for feeding the tool.

Still another object of the invention is to provide a device which is simpler in servicing and operation.

These and other objects are accomplished by providing a device for feeding an auxiliary tool into the working zone of the press comprising a body installed on a fixed base and carrying a tool rod, and a drive for moving said body jointly with the rod for feeding the tool into the working zone of the press wherein, according to the invention, the body is made in the form of a horizontally-movable platform located close to a fixed supporting element which is oriented relative to the working zone of the press in the direction of tool feed and in that said platform mounts a number of tool rods which can be moved relative to the platform by a discrete feed mechanism for bringing the required tool into the zone of the supporting element and can turn in a vertical plane around the supporting element for feeding the brought-out tool into the working zone of the press.

The body shaped like a movable platform carrying several tool rods makes it possible to introduce the required tool into the working zone of the press and if necessary, to replace the tool, by another one by merely setting in operation the discrete feed mechanism so that manual labour is dispensed with completely. This steps up labour efficiency considerably and broadens the technological capabilities of the device.

It is practicable that in the device according to the invention the tool rods should be installed on the platform with the aid of a rotatable faceplate which is connected by pins with the discrete feed mechanism in the form of two power cylinders with a common rod the latter being connected by levers with pins for bringing the required tool into the zone of the supporting element, i.e. supporting roller.

To facilitate servicing and improve reliability of the device according to the invention, the tool rods can be turned in the vertical plane by a power cylinder whose body is mounted on a slide located in the base while its rod is connected by links with the rotatable faceplate, said platform being installed on the slide.

For higher safety of the device it is practicable that the tool rods should be installed on the platform with the aid of brackets moving over the guides installed in holders, of which the lower holder is connected by pins with said discrete feed mechanism while the upper one is installed on the body of the power cylinder whose rod has an attached bushing provided on the outer surface with a projection entering a slot on the bracket for turning the tool rod in the vertical plane, the lower holder being also installed on said power cylinder.

Now the invention will be described in detail by way of examples with reference to the accompanying drawings, in which:

FIG. 1 is a general front view of the device according to the invention for feeding an auxiliary tool into the working zone of a press;

FIG. 2—same, longitudinal section;

Figure 1:
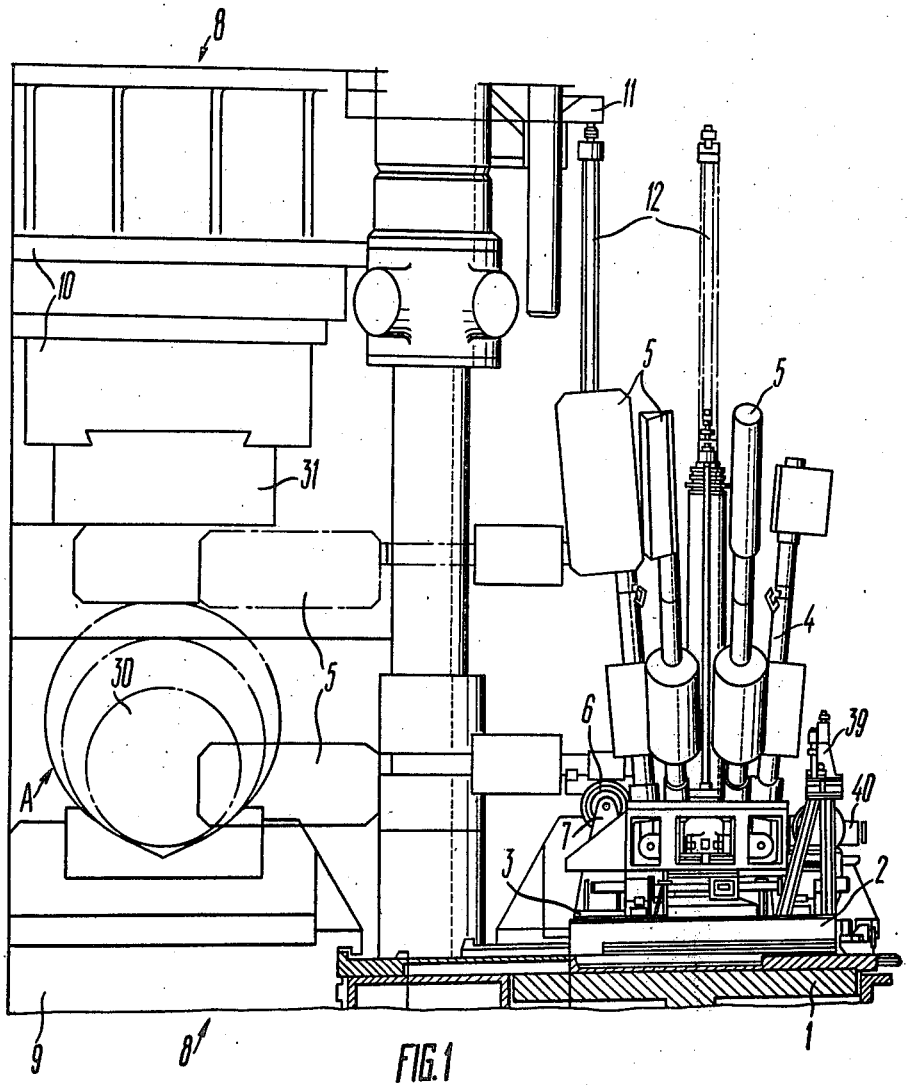
Figure 2:
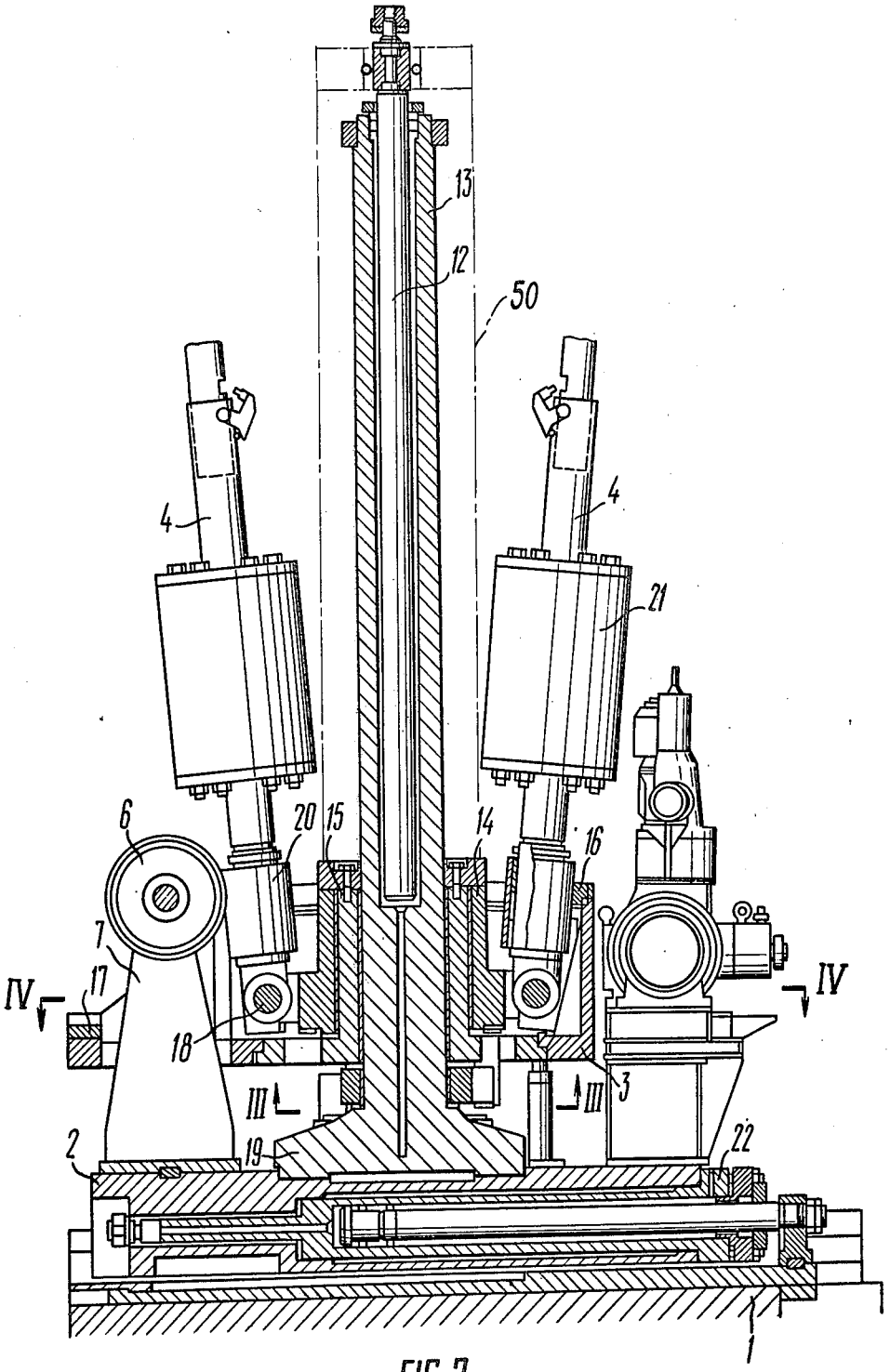

The device according to the invention for feeding an auxiliary tool comprises a base 1 (FIG. 1) with a slide 2 carrying a body. Said body is made in the form of a platform 3 with several tool rods 4 for auxiliary tools 5. The number of said tools depends on the number of the required auxiliary operations, in this case six. Installed near the platform 3 is a fixed supporting roller 6 secured by a bracket 7 on the slide and oriented relative to the working zone A of the press 8 along the feed of the tool 5. The base 1 of the device is set side by side with the base 9 of the press 8 whose movable cross-head 10 acts through a bracket 11 on the rod 12 of the power cylinder 13 (FIG. 2).

Figure 5:
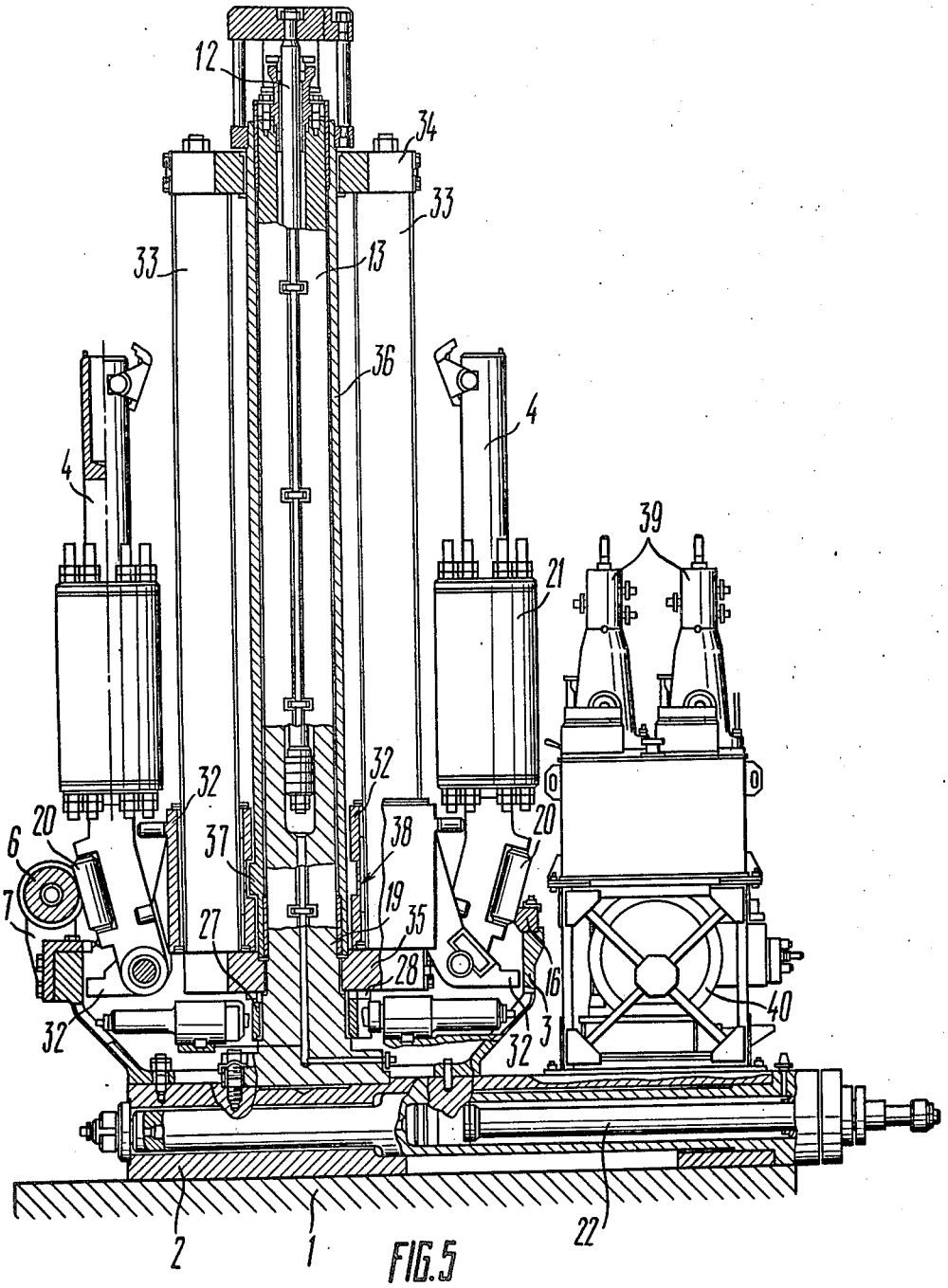
FIG. 5 is a longitudinal section of another version of the device according to the invention for feeding an auxiliary tool.

The tool rods 4 are installed on the platform 3 with a provision for relative movement. For this purpose they are mounted on a rotatable faceplate 14 which is connected by a bushing 15 with the platform 3. Said platform is provided with a supporting ring 16 and a supporting bracket 17. The tool rods 4 can also turn in a vertical plane around the supporting roller 6. For this purpose they are installed with the aid of brackets 18 on the faceplate 14 which is connected by links 50, as schematically illustrated in FIG. 2, with the rod 12 of the power cylinder 13 whose body 19 is installed on the slide 2. The links 50 extend from the top of rod 12 to the face plate 14 and move the face plate in much the same manner as bushing 36 moves bracket 32, as described in conjunction with the embodiment illustrated in FIG. 5. The tool rods 4 are provided with a roller 20 so that on turning of said rods said roller 20 interacts with the supporting roller 6 and shock absorbers 21.

The slide 2 is connected with a power cylinder 22 for moving said slide in a horizontal plane.

The faceplate 14 is turned by a discrete feed mechanism 23 (FIG. 3) which consists of two power cylinders 24 and 25 having a common rod 26. The latter is connected with the faceplate 14 by levers 27 and pins 28 whose ends are rigidly fixed on the levers 27 at one side and interact with the blocks 29 secured on the faceplate 14 at the other.

Figure 4:
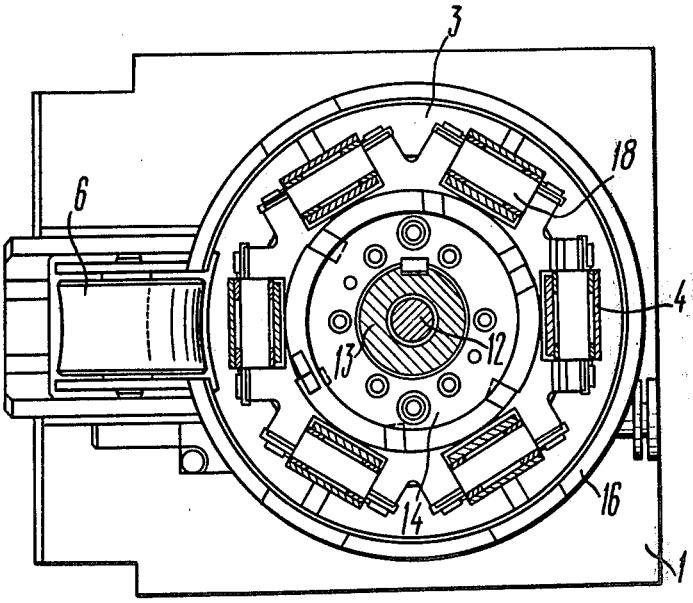
FIG. 4 is a section taken along line IV—IV in FIG. 2.

Shown in FIG. 4 is the arrangement of the tool rods 4 on the platform 3 which is shaped like a rotatable magazine and feeds the required tool into the working zone of the press.

In this version of the device the tool is fed as follows.

The platform 3 is in the downmost initial position. The rods 4 carrying the tools 5 rest with their rollers 20 on the supporting ring 16 and occupy a vertical position.

Before work, the tool 5 required for the given auxiliary operation is installed in position ready to be fed into the working zone A of the press 8. For this purpose the discrete feed mechanism 23 is set in operation by delivering pressure into the cylinder 24; the rod 26 turns the lever 27 and the pins 28 engage the blocks 29 of the faceplate 14, turning the latter through a desired angle. During rotation of the faceplate 14, the rollers 20 of the tool rods 4 roll over the supporting ring 16 and one of the rods settles on the roller 6. Then the retracting stroke of the cylinder 25 turns the lever 27 in another direction, opposite to its initial movement and the pins 28 are sunk in by the chamfers of the blocks 29. Then pressure is fed into the cylinder 13 and its rod 12 lifts the platform 3 to the required upper position. The tool rod 4 resting on the roller 6 turns in a vertical plane and comes to a horizontal position on the bracket 17.

With the tool rod in this position, pressure is fed into the cylinder 22 and the latter starts moving the slide 2 towards the press 8 so that the tool 5 is brought into the working zone A above the blank 30.

For executing a technological operation, e.g. cutting, the tool 5 cuts into the blank under the force of the upper striker 31. Simultaneously, the bracket 11 of the crosshead 10 presses the rod 12 of the cylinder 13 so that the platform 3 with the faceplate 14 goes down simultaneously with the tool 5.

On completion of the technological operation the crosshead 10 with the bracket 11 moves to the upper position and releases the platform 3 which is moved by the rod 12 of the cylinder 13 also to the upper position and withdraws the tool 5 from the blank 30. In this position the cylinder 22 moves the slide 2 to the initial position. The rod 12 of the cylinder 13 brings the platform 3 to the downmost position in which the rod 4 formerly occupying a horizontal position rests on the roller 6 and, turning around the hinge 18, comes to the initial vertical position. Then the working cycle is repeated over again.

Figure 3:
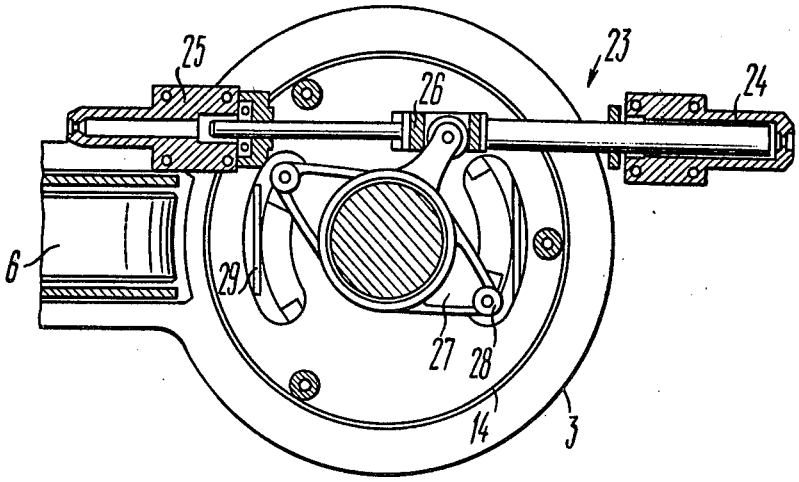
FIG. 3 is a section taken along line III—III in FIG. 2.

In another version of the device the tool rods 4 (FIG. 5) are installed on the platform 3 with the aid of movable brackets 32 which slide over the guides 33. Said guides are installed in the holders 34, 35 of which the lower one 35 is connected by pins 28 with the discrete feed mechanism 23 (FIG. 3). The upper holder 34 (FIG. 5) is installed on the body 19 of the cylinder 13 whose rod 12 has an attached bushing 36 fitting around the body 19 of said cylinder. The outer surface of the bushing 36 has a projection 37 entering a slot 38 provided on each movable bracket 32.

Installed on the slide 2 is a pumping plant 39 and distributors 40 controlling the operation of all the power cylinders.

In this embodiment of the invention the tool is fed as follows.

Before work, the brackets 32 with the tool rods 4 occupy the downmost position while the rods 4 with a set of tools rest with their rollers 20 on the supporting ring 16 of the platform 3 and are in a vertical position.

As pressure is supplied into the cylinder 24, the rod 26 moves to the left (on the drawing) and turns the lever 27 through a preset angle so that the pins 28 interact with the lower holder 35 and turn it together with the guides 33 and with the brackets 32 installed thereon. Having turned, the lower holder 35 is locked and the cylinder 24 is connected to the oil return line. Pressure is fed into the other cylinder 25 and the lever 27 makes an idle stroke in the opposite direction. The next power stroke of the cylinder 24 turns the holder 35 to a position in which the rod 4 with the tool 5 required for the given auxiliary operation is brought into the zone of the roller 6. In this position the slot 38 of one of the brackets 32 gets in line with the projection 37 of the bushing 36 and pressure is fed into the cylinder 13. The rod 12 of said cylinder 13 moves the bushing 36 and, by the projection 37 and slot 38, the bracket 32 to the uppermost position in which case the rod 4 rests with its roller 20 on the roller 6, turns in a vertical plane and comes to a horizontal position.

Then pressure is supplied into the cylinder 22 and the slide 2 starts moving towards the press 8, feeding the required tool into its working zone A.

On completion of the technological operation the slide 2 is moved by the cylinder 22 away from the press 8 and the cylinder 13 moves the bushing 36 with the bracket 32 and tool rod 4 to the downmost initial position. Then the next operating cycle is started again.

We claim:

1. A device for feeding an auxiliary tool into a working zone of a press, comprising: a fixed base; a horizontally movable platform mounted on said base; means for horizontally moving said platform; a fixed supporting element located near said platform and oriented relative to the working zone of the press in the direction of tool feed; a plurality of tools; a plurality of tool rods supporting said tools installed on said platform with a provision for moving relative to it; a discrete feed mechanism for moving said tool rods with respect to said platform so that a required tool is brought into the zone of said supporting element; means for moving said platform in a vertical direction, said tool rods being installed on said platform with a provision for turning in a vertical plane around said supporting element so that in the course of vertical movement of said platform the brought-out tool is positioned at the level of the working zone of the press.

2. A device according to claim 1 wherein the press includes a striker engageable with a tool positioned in the working zone of the press to move the tool and perform a predetermined operation on a blank positioned in the press and wherein said device is associated with the press in such manner that the tool positioned in the working zone of the press is contacted and moved by the striker and the platform on which the tool is installed is moved simultaneously with the tool.

3. A device according to claim 1 further comprising a rotatable faceplate for installing said tool rods on said platform, the discrete feed mechanism having two power cylinders, a common rod connecting said two power cylinders, and levers and pins for connecting said common rod and said rotatable faceplate, said supporting element being made in the form of a supporting roller.

4. A device according to claim 3 further comprising a slide installed in said base and wherein said means for moving said platform in a vertical direction comprises a power cylinder having a body located on the slide and a rod connected by links with the rotatable faceplate for vertically moving said faceplate, said platform being installed on said slide.

5. A device according to claim 3 further comprising brackets for installing said tool rods on said platform, guides for said brackets, upper and lower holders for holding said guides, pins for connecting said lower holder with said discrete feed mechanism, said means for moving said platform in a vertical direction comprising a power cylinder having a body and a rod with an attached bushing provided on the outside with a projection entering a slot made in each bracket for vertically moving the bracket thereby turning the tool rod in a vertical plane, the upper and lower holders being installed on the body of the power cylinder.

* * * * *